US005084690A

United States Patent [19]

Leupold

[11] Patent Number: 5,084,690

[45] Date of Patent: Jan. 28, 1992

[54] STEPPED MAGNETIC FIELD SOURCE

[75] Inventor: Herbert A. Leupold, Eatontown, N.J.

[73] Assignee: The United States of America as represented by the Secretary of the Army, Washington, D.C.

[21] Appl. No.: 695,148

[22] Filed: Apr. 29, 1991

[51] Int. Cl.[5] ..... H01F 7/02; H01F 7/00; H01J 23/18

[52] U.S. Cl. ..... 335/306; 335/304; 335/210; 335/214; 315/5.35

[58] Field of Search ..... 335/209, 210, 211, 212, 335/214, 296, 297, 298, 301, 302, 304, 306; 315/5.34, 5.35; 324/205; 29/593, 607, 608, 609

[56] References Cited

U.S. PATENT DOCUMENTS 3,334,264 8/1967 Niclas ..... 335/306

5,055,812 10/1991 Abele et al. ..... 335/210

*Primary Examiner*—Leo P. Picard

*Assistant Examiner*—Ramon M. Barrera

*Attorney, Agent, or Firm*—Michael Zelenka; William H. Anderson

[57] ABSTRACT

An improved permanent magnet solenoid having a stepped transition in axial magnetic field profile and comprised of two permanent magnet solenoids, with appropriate cladding, placed in tandem and a radially magnetized ring magnet placed within the working cavity of the solenoids at the joint of entire structure.

2 Claims, 5 Drawing Sheets

STEPPED MAGNETIC FIELD SOURCE

GOVERNMENT INTEREST

The invention described herein maybe manufactured, used and licensed by or for the Government of the United States of America for governmental purposes without the payment to me of any royalties thereon.

TECHNICAL FIELD

The present invention relates generally to permanent magnetic structures which produce a stepped axial magnetic field profile and more particularly to permanent magnet solenoids placed in tandem which produce a stepped transition between the magnetic fields of the individual permanent magnet solenoids.

BACKGROUND OF THE INVENTION

With the ever increasing technical developments in highenergy electron-beam radiation sources, there has also been an increased need for more complex and varied magnetic field configurations in permanent magnet solenoids. For example in some electron-beam devices such as gyro amplifiers, a stepped magnetic field with a narrow transition is desirable.

In order to produce such a magnetic field it would be obvious to place in tandem two permanent magnetic solenoids such as those disclosed in U.S. Pat. No. 4,647,887, issued to Leupold on March 3, 1987, entitled, "Lightweight Cladding For Magnetic Circuits," or in U.S. Pat. No. 3,768,054 issued to Neugebauer and entitled, "Low Flux Leakage Magnetic Construction." Neugebauer discloses a permanent magnet solenoid wherein the leakage of magnetic flux of a first magnet is prevented by placing a second permanent magnet adjacent the first magnet with the magnetic axis of the second magnet perpendicular to the axis of the first magnet. Leupold discloses a permanent magnet structure which comprises, in combination, a longitudinally extending first magnet having a longitudinal magnetic polarity, a second magnet surrounding a substantial portion of the length of the first magnet, and having a generally radial magnetic polarity transverse to the longitudinal magnetic polarity of the first magnet, the second magnet also having a constant magnetic potential on its outer surface of the first magnet at a circumferential portion between the ends thereof.

Placing either one of these structures in tandem with itself as shown in FIG. 3 would produce a stepped magnetic field which would be useful in such applications as a gyro amplifier. However, the magnetic field produced by such a structure would not be ideal for a gyro amplifier because the transition between the two fields would be relatively gradual.

SUMMARY OF THE INVENTION

Therefore, it is an object of the present invention to provide a means to adjust the transition of magnetic fields between magnetic flux sources.

It is another object of the present invention to provide an improved permanent magnet solenoid wherein the transition in magnetic field between two permanent magnet solenoids is nearly a perfect step function.

In general, the invention comprehends a magnetic structure which comprises, in combination, two hollow cylindrical permanent magnet solenoids of varying magnetic field strength placed in tandem and a radially and/or axially magnetized ring(s) placed at a predetermined location(s) within or on the exterior of the permanent magnet solenoids.

In the preferred embodiment of the invention the solenoids are clad in such a manner so as not to permit magnetic flux from leaking to the exterior of the solenoid. This can be accomplished by the method shown in Neugebauer or Leupold, both of which are referenced above and incorporated herein.

In fabrication, the solenoids are placed end to end as shown in FIG. 1*b* such that the output end of a first solenoid is connected to the input end of a second solenoid. As shown in FIG. 1*b*, the iron pole pieces which would otherwise seal the solenoid are partially removed to form the hollow cavity in which the electron beam is to travel. However, by partially removing the iron pole pieces, a relatively smooth transition between the magnetic fields of the two solenoids is created. This smooth transition is sharpened or smoothed by the present invention which comprises the addition of a radially and/or axially magnetized annular magnet(s) t a predetermined position within or on the exterior of the permanent magnet solenoids.

DETAILED DESCRIPTION OF THE INVENTION

Figure 1A:
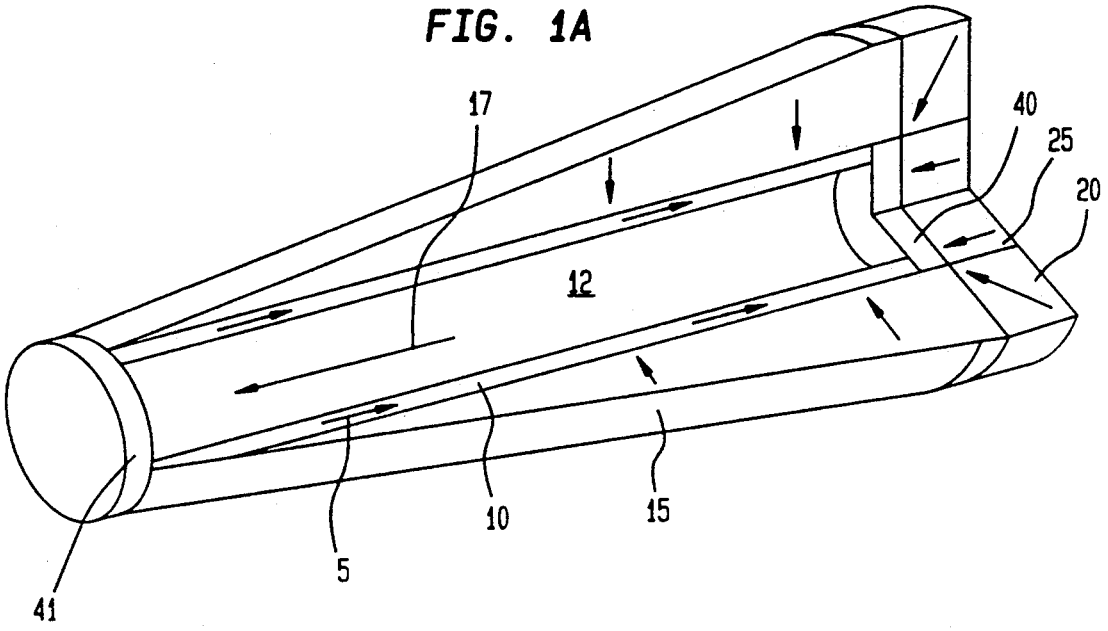
FIG. 1*a* is a longitudinal cross-section of a prior art device.
Figure 1B:
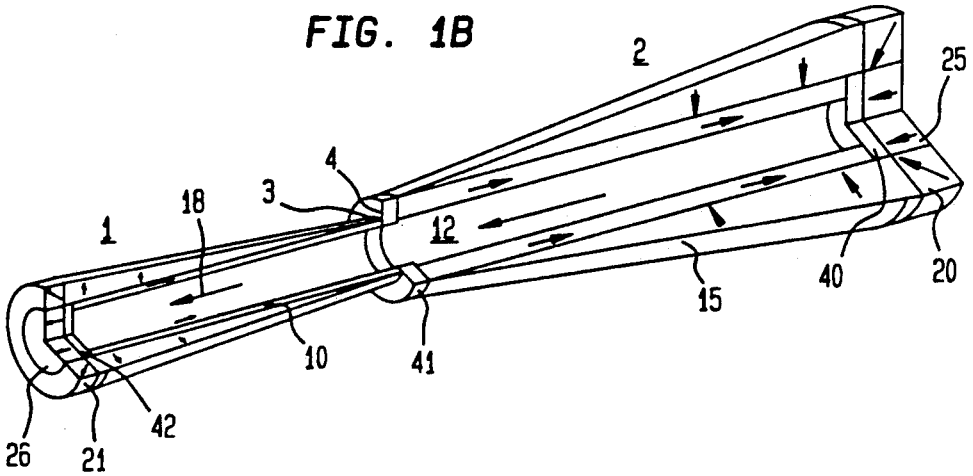
FIG. 1*b* is a longitudinal cross-section of a two prior art devices placed in tandem.

Referring to FIG. 1*a*, magnet 10 is a uniformly magnetized hollow cylindrical magnet having a polarity in the direction indicated by arrow 5. Iron disk 40 and 41 seal the ends of magnet 10. The magnetic flux for the solenoid is then provided by the hollow cylindrical supply magnet 10 wherein the magnetic flux is oriented parallel to the longitudinal axis of the supply magnet and is led into the interior of the working cavity 12 through iron pole pieces 40 and 41. In order to insure that none of the generated flux leaks to the exterior of the structure, a radially magnetized conical magnet 15 clads the exterior of the supply magnet and an axially magnetized magnetic disk 25 clads the base of one of the pole pieces. Diagonally magnetized corner piece 20 completes the cladding. Such a structure is generally disclosed in Neugebauer and Leupold, referenced above. To produce a stepped magnetic field source, two such conically clad magnet structures of varying magnetic field magnitudes, solenoids 1 and 2, are then placed in tandem end-to-end at unclad ends 3 and 4 as shown in FIG. 1*b*. The pole piece 41 at the joint is partly removed so that there is no partition separating the cavities and the ends of the structure are pierced by circular holes to allow access to an electron beam.

The dimensions of the foregoing parts are determined according to the information more fully described in the following references: "Applications of Cobalt-Samarium Magnets to Microwave Tubes," by W. Neugebauer and E.M. Branch, Technical Report, Microwave Tube Operation, General Electric, 15 Mar. 1972; J.P. Clarke and H.A. Leupold, IEEE Transactions Magazine, MAG-22, page 1063 (1986); and E. Potenziani and H.A. Leupold, IEEE Transactions Magazine, page 1087 (1986). These dimensional determinations are summarized as follows:

(1) Supply magnet outer radius Rs:

$$Rs = Rw\ Hw/(Br-Hw)+1\ ;$$

(2) Pole piece thickness Tp:

$$T = HwRw/40;\ \text{and}$$

(3) Maximum cladding magnet thickness Tc:

$$Tc = HwLw/Hc,$$

where Hw is the desired field in the working space W in kOe; Rw is the radius of the working space in centimeters; Br is the magnetic remanence of the permanent magnet material in kG; Hc is the coercivity of the magnetic material in kOe; and Lw is the length of the working space in centimeters.

Figure 2:
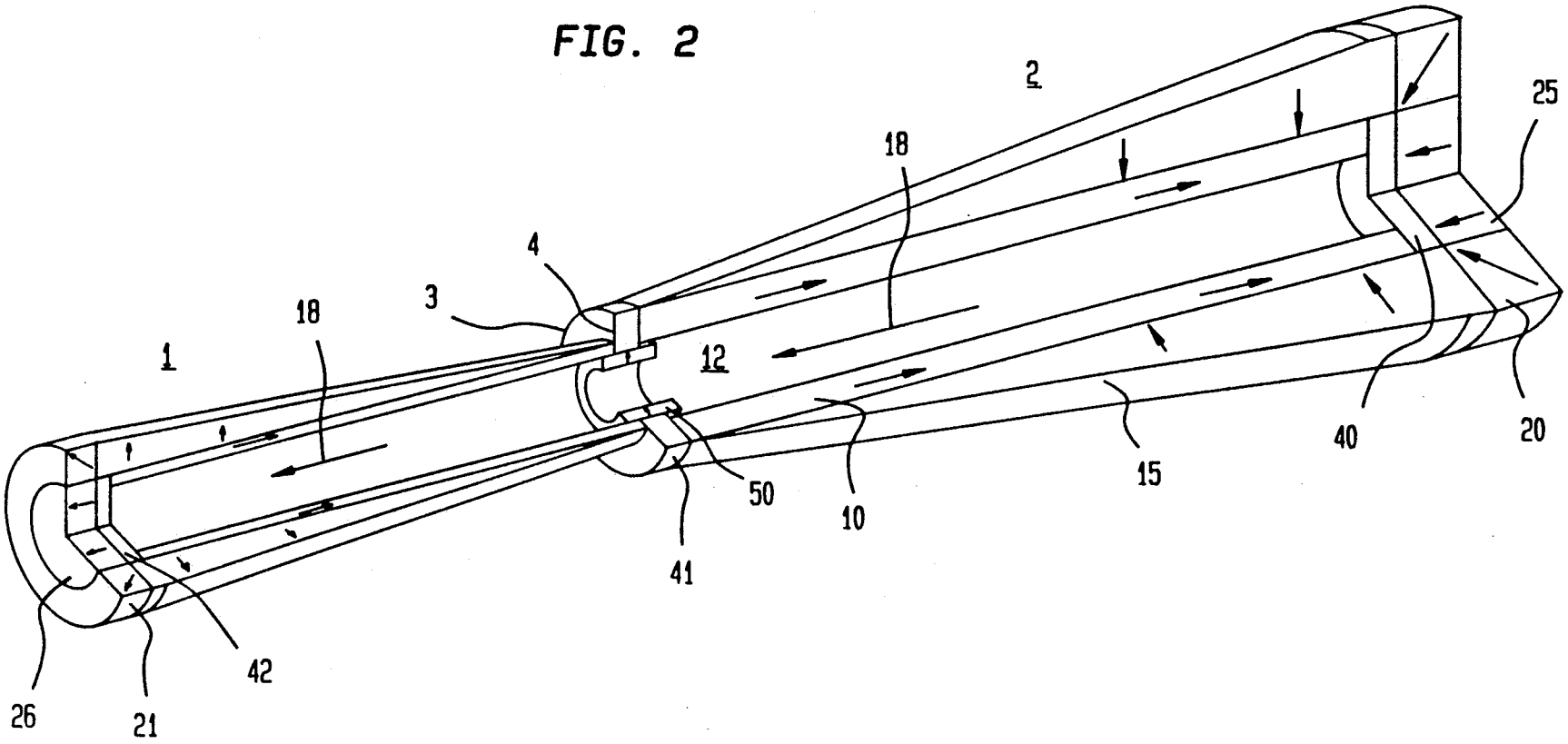
FIG. 2 is a longitudinal cross-section of a device embodying the present invention.
Figure 3:
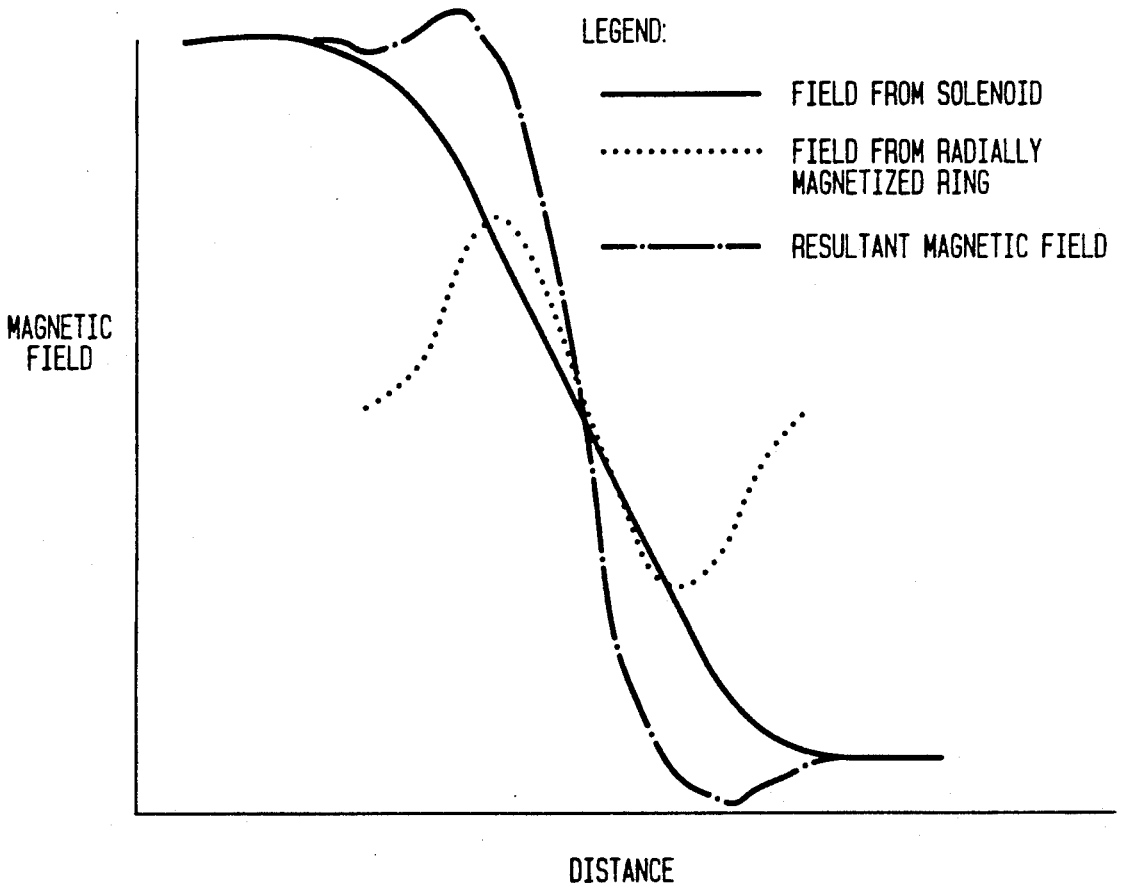
FIG. 3 is a graphical comparison of the transition in magnetic field between the device shown in FIG. 1*b* and FIG. 2

The removal of part of the pole piece 41 at the joint causes a rather broad transition in the field profile as shown in FIG. 3. The slight slope of the field curves in both chambers is due to imperfect cladding at the ends of the composite structure. A more abrupt field transition is attained by the present invention by use of a radially magnetized ring 50 placed centrally at the joint between solenoids 1 and 2, as shown in FIG. 2. The ring is placed at the interior of the solenoid rather than on the outside to prevent unwanted polarization of the remaining iron pole pieces.

FIG. 3 is a comparison of axial field distributions between the devices shown in FIG. 1*b* and FIG. 2. As is shown by FIG. 3, with a radially magnetized ring 50 of appropriate dimension and remanence, an axial field profile is produced which is nearly a perfect step transition.

Figure 4:
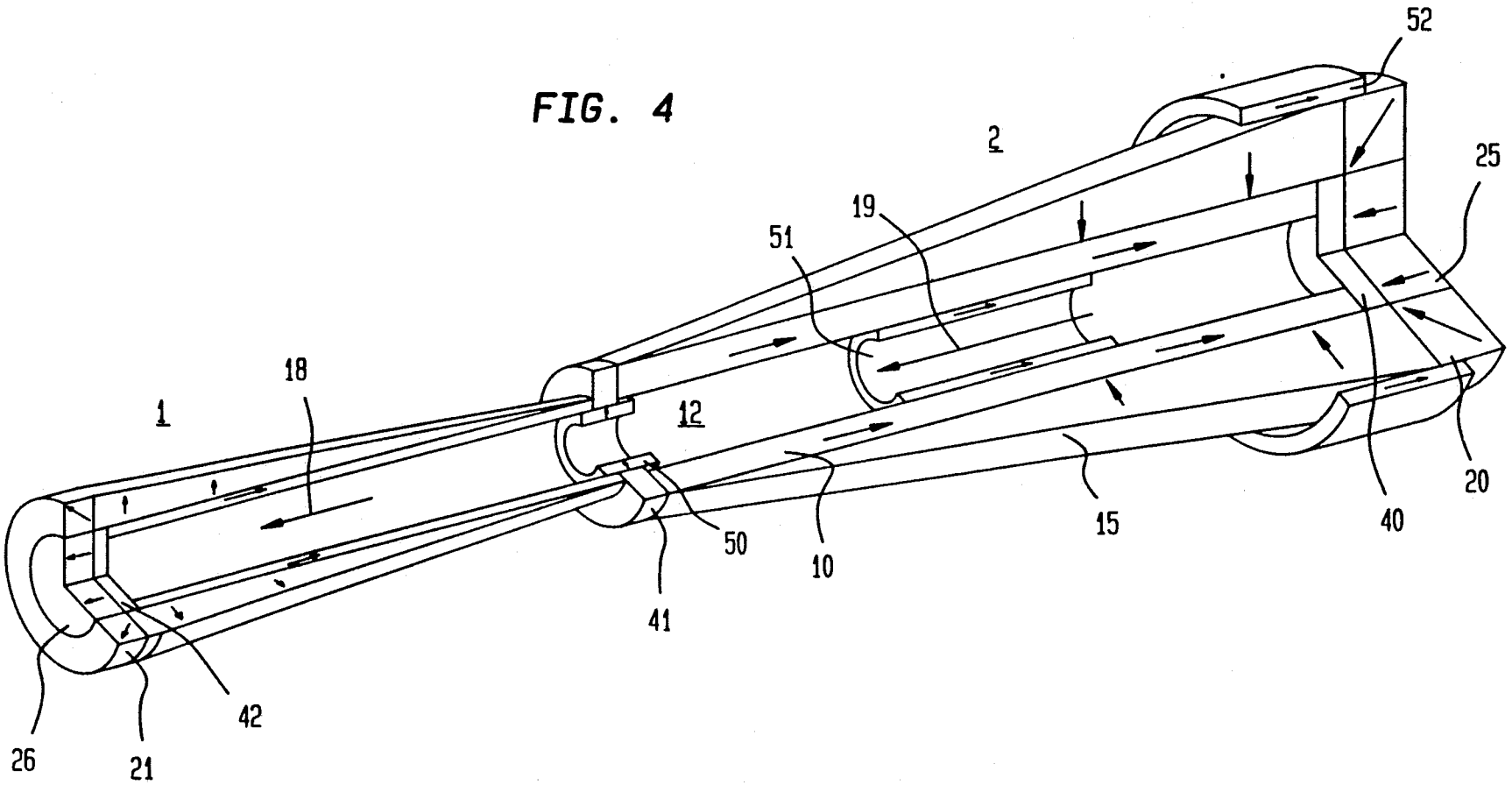
FIG. 4 is a longitudinal cross-section of another device embodying the present invention.
Figure 5:
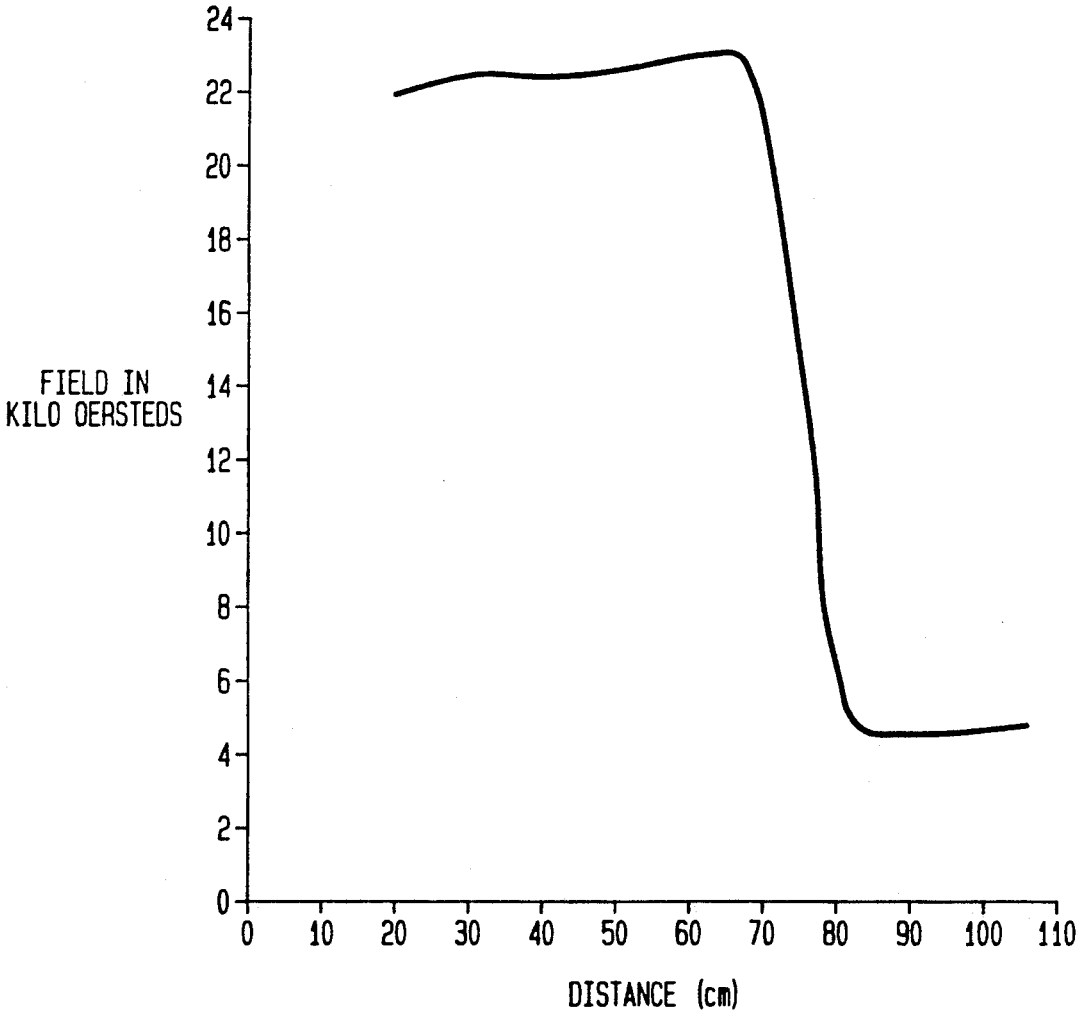
FIG. 5 is a graphical representation of the magnetic field profile produced by the Device illustrated in FIG. 4.

The sloped portions of the axial field curve, however, may also be made flat by a variation along the axis of the remanences of the cladding magnets in the same proportion as the variation of the axial field from the desired constant value; this variation is disclosed in Potenziani and Leupold referenced above. Ideally, this variation is continuous, but a step like variation with as little as four remanence values may provide field that is sufficiently smooth for most purposes. However, field smoothing can also be accomplished by the present invention which utilizes the addition of axially magnetized rings whose fields are equivalent to the changes resulting from an alteration of remanence in the supply magnet at the location in question. As shown in FIG. 4, axially magnetized ring magnets 51 and 52 are added to the structure of FIG. 2. As shown in FIG. 5, the magnetic fields, as represented by arrows 18 and 19 of FIG. 4, become flat to within two percent and the transition width is narrowed from 25 to 15 centimeters.

It shall be understood that the embodiment depicted can be combined in different configurations, and that numerous modifications or alterations may be made therein without departing from the spirit and scope of the invention as set forth in the appended claims.

What is claimed is:

1. A permanent magnet solenoid for the generation of a stepped magnetic field comprising a first hollow cylindrical magent having a uniform magnetization oriented in a direction along a longitudinal axis of said first cylindrical magnet, a first cladding means disposed around the first cylindrical magnet such that the cladding means reduces the amount of magnetic flux leakage from the permanent magnet solenoid, a second hollow cylindrical magnet having a uniform magnetization oriented in a direction along the longitudinal axis of said first cylindrical magnet and in the same direction as said first cylindrical magnet, the second cylindrical magnet being connected at an end of the first magnet forming a joint therebetween and a working cavity, and cladding means disposed around the second cylindrical magnet such that the cladding mans reduces the amount of magnetic flux leakage from the permanent magnet solenoid, the improvement comprising:

a radially magnetized magnetic ring connected to said first and second cylindrical magnets in the interior of the working cavity and at the joint of the permanent magent solenoid; and a plurality of axially magnetized rings positioned at predetermined locations to adjust for variations in remanence o the permanent magnet solenoid.

2. A method of correcting alternating remanence values within permanent magnet structures comprising the steps of:

a. fabricating a hollow permanent magnet structure, b. determining variations of magnetic remanence within the permanent magnet structure, c. placing axially magnetized rings at predetermined locations to adjust for the variations in remanence of the permanent magnet structure.

* * * * *